US005401203A

United States Patent [19]

Fildan

[11] Patent Number: 5,401,203

[45] **Date of Patent: * Mar. 28, 1995**

[54] METHOD OF MATCHING BRASSIERE WIRE OR STAY TO A BRASSIERE CUP

[76] Inventor: Gerhard Fildan, Wohnpark Alt Erlaa, Anton Baumgartner Strasse C 4 17 01, A-1232 Wien, Austria

[ * ] Notice: The portion of the term of this patent subsequent to Jun. 15, 2010 has been disclaimed.

[21] Appl. No.: 35,668

[22] Filed: Mar. 23, 1993

Related U.S. Application Data

[63] Continuation-in-part of Ser. No. 937,964, Aug. 28, 1992, Pat. No. 5,219,311.

[51] Int. Cl.[6] ..... A41C 1/12; A41C 1/14

[52] U.S. Cl. ..... 450/41; 450/47; 450/52; 450/92; 2/260.1

[58] Field of Search ..... 2/67, 73, 260.1, 261, 2/262, 263, 264, 259; 450/41, 42, 43, 44, 45, 46, 47, 48, 49, 50, 51, 52, 53, 54, 55, 56, 92

[56] References Cited

U.S. PATENT DOCUMENTS

| | | | |
|---|---|---|---|
| 1,798,274 | 3/1931 | Pons | 450/41 |
| 2,227,214 | 12/1940 | Bisberg | 2/73 |
| 5,219,311 | 6/1993 | Fildan | 450/41 |

*Primary Examiner*—Clifford D. Crowder
*Assistant Examiner*—Jeanette E. Chapman
*Attorney, Agent, or Firm*—Herbert Dubno

[57] ABSTRACT

A method of making a brassiere wire for a particular underwire brassiere cup utilizing a set of brassiere wires having rectilinear markings where excess of the wire can be cut away with rounding of the resulting end portions to form the brassiere wire.

8 Claims, 4 Drawing Sheets

METHOD OF MATCHING BRASSIERE WIRE OR STAY TO A BRASSIERE CUP

CROSS REFERENCE TO RELATED APPLICATION

This application is a continuation-in-part of Ser. No. 07/937,964, filed 28 Aug. 1992, now U.S. Pat. No. 5,219,311.

FIELD OF THE INVENTION

My present invention relates to a brassiere wire and stay for so-called underwire brassieres, i.e. a wire adapted to be inserted into a channel in a fabric brassiere below the breast, adapted to lie against the sternum and the lateral pectoral region and composed of a synthetic resin or plastic material so as to provide stability and flexibility to the brassiere in these regions.

More particularly, the invention relates to a method of matching a brassiere wire to a particular brassiere cup, e.g. in the production of brassieres or for sample making and the specific selection of a wire.

BACKGROUND OF THE INVENTION

So-called brassiere wires are well known and comprise a wire which may be independent or part of a frame and which has an arcuate shape, while being received in a correspondingly shaped channel stitched into the fabric of the brassiere to extend along the underside of each brassiere cup, to lie generally against the sternum and lateral pectoral region and to provide support for the breast.

Such brassiere wires are provided in a variety of shapes and configurations and must satisfy a number of requirements. For example, the brassiere wire must not pose danger to the wearer by poking through the fabric to cause injury or to damage clothing of the wearer. It also must be readily insertable.

The wire should tolerate washing and be compatible with the wearer, should not present excessive stiffness, but yet be capable of providing support without permanent distortion or shape change which may result in distortion of the shape of the brassiere.

In U.S. Pat. No. 4,306,565, for example, a brassiere wire is disclosed which has encapsulated tips with locking pins extending through apertures in the plastic tip to retain the latter on the wire. In U.S. Pat. No. 4,175,740, a brassiere frame is provided in which two brassiere wires are joined together at sleeve-shaped members at the center of the frame and tips similar to those previously described are provided on the free ends of the wire.

Another underbust flat wire for use below a brassiere cup is described in U.S. Pat. No. 4,133,316 and likewise has tips at the ends thereof. Stitching through brassiere frame members is described in U.S. Pat. No. 3,702,614.

To avoid the drawbacks of a metallic wire which might poke through the brassiere, U.S. Pat. No. 3,114,374 describes a brassiere stay in which the wire is completely encased in plastic tubing with the ends of the tubing crimped over the ends of the wire.

A breast-enhancement brassiere is described in U.S. Pat. No. 5,098,330 and likewise has a wire extending within a channel along and following the curvature of the cup of a brassiere. The cups of a camisole garment can likewise be provided with a wire (U.S. Pat. No. 5,045,018) and, as noted, metallic spring wire has been used to form a stiffening member for a brassiere (U.S. Pat. No. 4,770,650), a portion of this member being annealed to soften it.

A method of making a brassiere wire whereby a sheath of flexible material is formed around a wire member and an end thereof is broken off within the sheath is described in U.S. Pat. No. 4,285,113.

U.S. Pat. No. 4,245,644 discloses a brassiere with support providing kinetic energy transfer and U.S. Pat. No. 4,201,220 discloses another brassiere wire having sheathed tips. A tubular wire form inserted into a knit article for a seamless brassiere is the subject of U.S. Pat. No. 3,772,899 whereas the brassiere described in U.S. Pat. No. 3,726,286 encloses underbust wire stays which are secured to lower edge portions and inner and outer layers of the breast cups. Still earlier designs using undercup stays, wires or frames are found in U.S. Pat. Nos. 3,717,154; 3,701,614; 3,599,643; and 3,394,706. (See also U.S. Pat. Nos. 3,252,460; 3,126,007 and 2,109,431.)

Notwithstanding the considerable efforts expended in developing brassiere wires or stays heretofore, it has been found that problems remain with respect to the comfort of a brassiere equipped with a wire or stay, especially when that wire or stay extends above the midway point across the cup. In such cases, comfort problems do arise where the wire or stay is excessively stiff.

Another problem which arises with underwire brassieres is the design and selection of a wire appropriate to the particular curvature of the cup and the length of the compartment of the cup in which the wire is to be received. In the past, the development of a wire specific to a particular cup design and size has been made on an ad hoc basis with the wire having to be molded and reshaped repeatedly for the particular cup or brassiere design.

OBJECTS OF THE INVENTION

It is, therefore, the principal object of the present invention to provide an improved brassiere wire or stay whereby drawbacks of earlier such stays are avoided.

Another object of the invention is to provide an improved set of brassiere wires designed for use in brassieres of a number of sizes, which all have an improved comfort factor by comparison with earlier stays or wires.

Still another object of the invention is to provide a brassiere wire or stay which is particularly comfortable to wear, can be inserted and retained in the brassiere particularly conveniently and without endangering the user or garments of the user, and which is inexpensive to manufacture.

It is still another object of this invention to provide an improved method of selecting a wire for an underwire brassiere cup or of making a brassiere wire specific to a particular cup whereby drawbacks of earlier methods are avoided.

SUMMARY OF THE INVENTION

According to the present method, a set of brassiere wires having the advantages of brassiere wires of the aforementioned copending application is provided, the rectilinear portions of the wires being previously provided with markings which can be used by the designer to cut off the excess length of the rectilinear portion utilizing, for example, a simple nail clip, whereupon the edges of the wire can be rounded, e.g. with a nail file.

More particularly, a method of making a brassiere wire specific for a given underwire breast cup of a brassiere comprising the steps of:

(a) providing a set of brassiere wires each having a circular arc segmental portion having a common center of curvature for all of the wires of the set and respective mutually parallel rectilinear end portions, the wires being of substantially equal width uniform over the lengths thereof, being composed of plastic, being flat and coplanar and having inner and outer edges of lengths equal substantially to outer and inner edges of neighboring inwardly and outwardly lying wires of the set, the wires having radii of curvature of the arc segmental portions, total lengths and lengths of respective median lines between respective inner and outer edges which are graduated increasingly from a smallest wire of the set to a largest wire of the set;

(b) forming each of the rectilinear end portions of each wire of the set with a plurality of markings representing cut-off locations for matching the respective wire to a brassiere cup of a respective size;

(c) cutting off each of the end portions of a selected wire having an arc segmental portion of a radius corresponding to an arc of the underwire breast cup to which a specific wire is to be matched; and (d) rounding off cut ends of the specific wire.

Specifically, the markings of the wires of the sets lie generally along radii or chords of the set of brassiere wire or stay has a curved portion extending from a rectilinear portion forming one free end of the wire to a rectilinear portion which can form flexible zone at which the wire becomes rectangular and extends substantially beyond a semicircle, the wire being of flat cross section while being composed of a plastic or synthetic resin of a composition hitherto used for the fabrication of brassiere wires, such as a polyolefin like polypropylene or polyethylene, a polyamide such as a nylon or a polyester.

According to the invention and utilizing principles of the earlier application, the flexible rectilinear portion can have enhanced flexibility for deflection out of the plane of the wire by reason of a pair of spaced-apart thin regions, i.e. regions of reduced thickness perpendicular to this plane and dimensioned so that the deflection of the zone out of the plane causes the bend of the wire in this region to have a circular arc segmental shape of generally constant radius.

According to the invention, therefore, a flexure or flexible zone extends rectilinearly at least on one side of the semicircular arc of the brassiere wire although the flexible zone can be provided at both ends of the wire if desired. The thin regions of the flexible zones preferably extend perpendicularly to the longitudinal edges of the rectilinear portion and the innermost zone can have a greater thickness than the outermost zone. The wire can taper in thickness along its length, although it is preferred to provide the region between the thin zones so that its thickness is less than that of the body of the wire while the terminal region of the flexible zone between its tip and the outermost thin region is itself thinner than the intermediate region.

According to another feature of the invention, the wire forms one of a set of wires differing by the radial width as to the radius of the semicircular portion. Between the longitudinal edges of the wire, a neutral middle line can be provided which, for brassieres of sizes ranging from 32 AA through 46 DD including intermediate sizes with cups A–C, for example, can range from 184 mm to 387 mm in length. Typical neutral middle line lengths for this size range can be 184, 201, 218, 235, 252, 269, 286, 303, 320, 336, 353, 370, and 587 mm.

The thickness of the body of the wire may range between 1.5 and 2.5 mm and is preferably between 1.8 and 2.2 mm. The radial width of the body of the wire may be between 3.4 and 4.1 mm and preferably is about 4 mm.

The wire can have, in a preferred embodiment, a body thickness of 2.0 mm, an inner thin region with a thickness of 1.40 mm an intermediate thickness region of 1.50 mm, an outer thin region with a thickness of about 1.0 mm and an outermost region of a thickness of about 1.35 mm.

The cross section of the wire at the body, the thin regions or grooves and the intermediate and outer regions is preferably rectangular with rounded corners forming thereby respective transitional regions with gradually increasing, respectively decreasing thickness therebetween.

The radius of curvature of the neutral median line may range from 45 mm to 88 mm.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
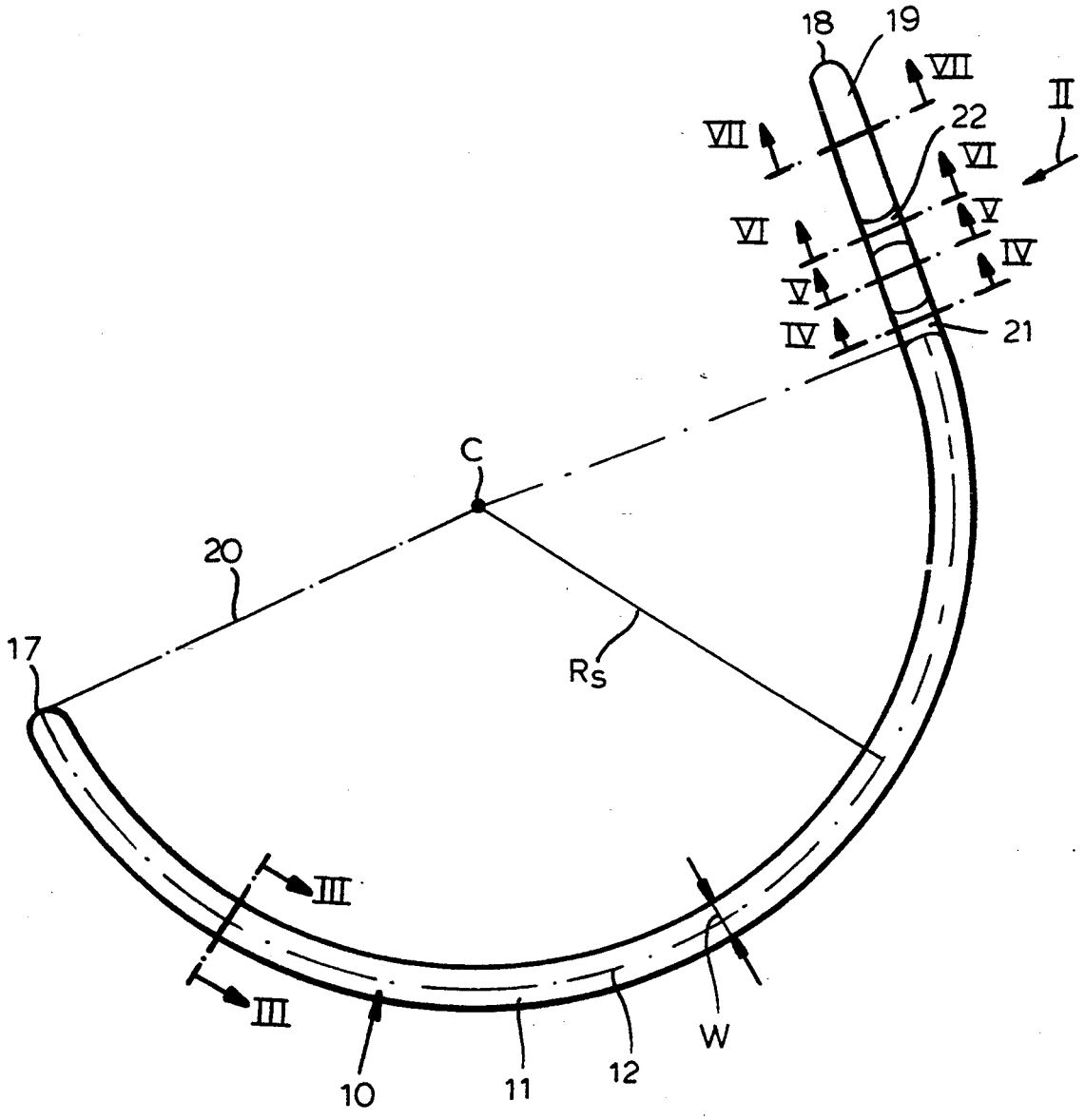
FIG. 1 is an elevational view of a plastic brassiere wire or stay, according to the invention.

In FIG. 1 of the drawing, I have shown a brassiere wire 10 which has a semicircular portion 11 with a radius of curvature $R_S$ running to a neutral middle line 12 midway between the longitudinal edges 13 and 14 of this portion of the brassiere wire.

Figure 3:
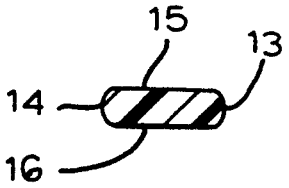
FIG. 3–7 are cross sectional views taken along lines III—III, IV—IV, V—V, VI—VI, and VII—VII of FIG. 1, respectively.

The body 11 is of flattened cross section (see FIG. 3) with planar surfaces 15 and 16 parallel to the plane of the paper of FIG. 1 and parallel to the plane of the wire. The wire is composed of one of the plastics previously described and is inserted in a channel of a brassiere below a breast cup thereof and extends upwardly from the region below the breast cup where the wire lies against the sternum to the lateral pectoral region. The tips of the wire are rounded at 17 and 18.

Figure 4:
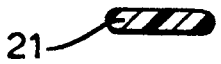
Figure 5:
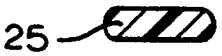
Figure 6:
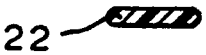
Figure 7:
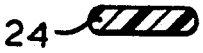

As can be seen from FIG. 1, the wire has a flexible rectilinear zone 19 which extends beyond the diameter 20 which runs through the center C and the tip 17 and which is formed unitarily with the body 11 by injection molding therewith and has two spaced-apart grooves 21 and 22 respectively and cross sections shown in FIG. 4 and 6, providing flexibility to this rectilinear portion or flexible zone.

Figure 2:
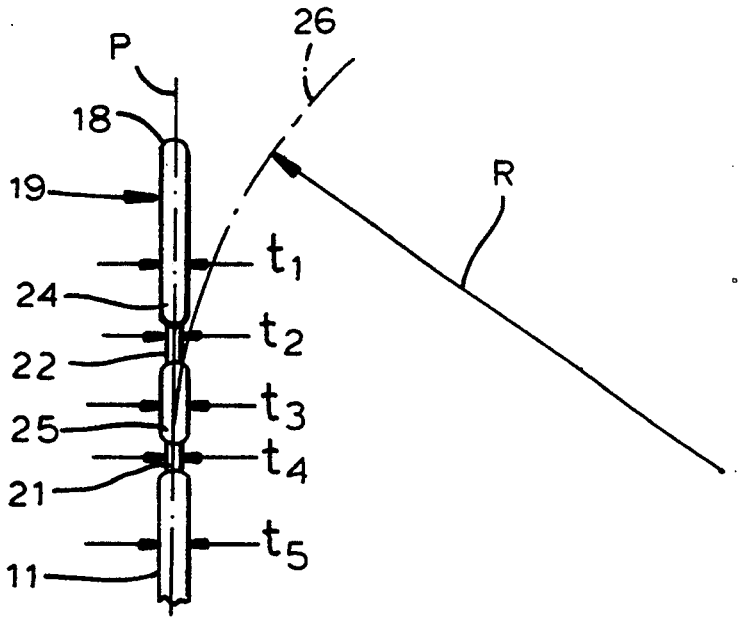
FIG. 2 is a view of the flexible zone or rectilinear portion of this wire as seen in the direction of the arrow II of FIG. 1.

As can be seen from FIG. 2, the body of the wire can have a thickness $t_5$ which is greater than the thickness of the intermediate region 25 between zones 21 and 22 and the end zone 24 provided with the tip 18. The thicknesses of the regions 24, 22, 25, 21 and 11 are thus represented at $t_1$ to $t_5$ respectively with respective transitional regions therebetween denoted $t'_1$ to $t_5$ having gradually varying thickness. The thickness $t_2$ is less than $t_4$, so that the flexible zone 19 will deflect along a circular pattern represented at 26 out of the plane P of the brassiere wire with a radius of curvature R.

The width of the wire remains constant over its entire length and is represented at W, although, if desired, this width can taper toward the ends. A flexible rectilinear zone can be provided as well on the opposite end of the wire.

Figure 8:
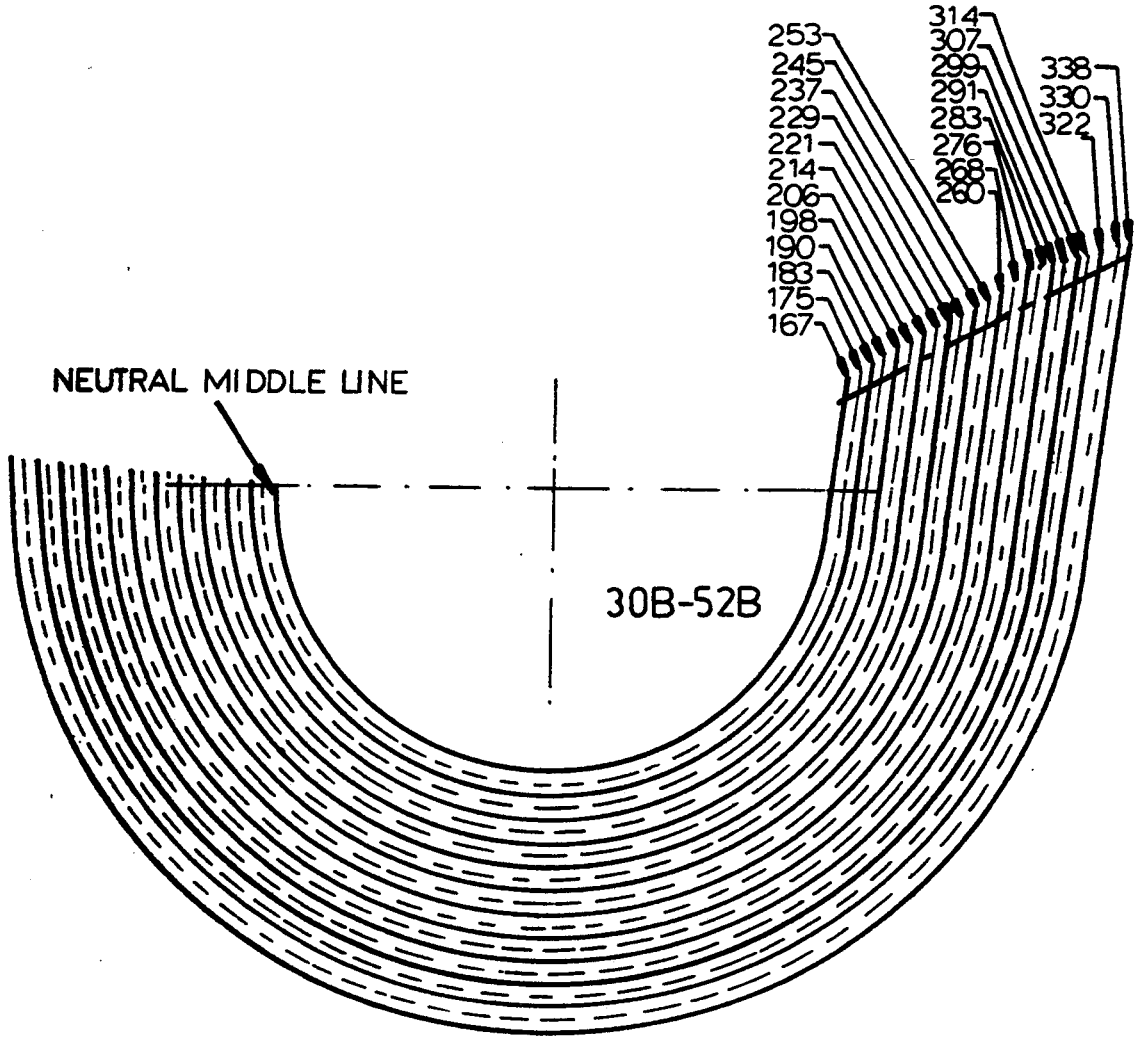
FIG. 8 is a diagram of a set of brassiere wires illustrating an aspect of the invention.

As can be seen from FIG. 8, a set of such wires can be provided with identical widths W of say, 4 mm and identical cross sections, but different diameters or radii of the semicircular portion and different neutral middle line lengths for a range of brassiere sizes. Preferred cross sections of the semicircular body are $4.1\times2.2$ and $3.5\times1.8$, the cross sections being rectangular (FIGS. 3–7) with rounded corners.

In a particularly preferred embodiment, for a width W of about 4 mm, a radius R of about 72 mm, the body can have a thickness of 2.0 mm, the inner groove can leave a thickness $t_4$ of 1.4 mm, $t_3$ can be 1.5 mm, $t_2$ can be 1.0 mm and $t_1$ can be 1.35 mm.

With brassiere wires of this construction, a high flexibility is provided without permanent deformation out of the plane of the wire as is particularly important at the sternum and pectoral regions while within the plane, the wire has adequate support stability. Piercing through the fabric does not occur and the wires have been found to be particularly comfortable.

Figure 9:
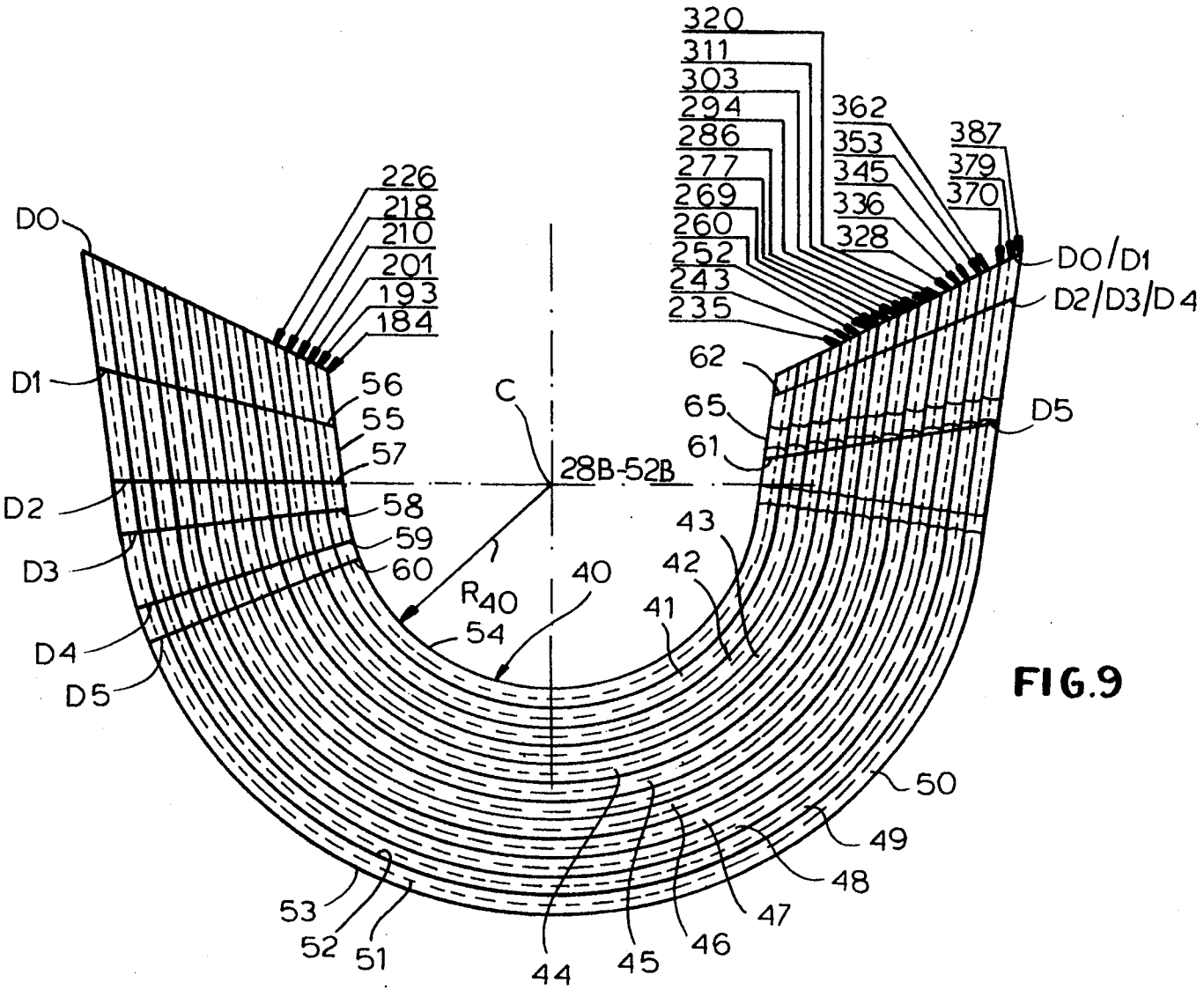
FIG. 9 is a diagram showing another set of brassiere wires illustrating the principles of the marking along which excess lengths are cut off.

In FIG. 9, a set of brassiere wires 40, 41, 42, 43, 44, 45, 46, 47, 48, 49, 50 are provided with respective neutral median line lengths 51 ranging in steps from 184 mm upwardly in intervals of say 17 mm. The typical inner edge and outer edge lengths 52 and 53 have also been given for these wires in the drawing and the wires are designed for a full range of brassiere sizes from say 32 AA to 46 DD, respectively.

Each of the wires has an arcuate or arc segmental portion 54 and a pair of rectilinear portions 55 and 56, the latter being provided with a reduced cross section zones previously described. The wires of the set are graduated of radii $^R40$, for example, of the respective median lines from a common center of curvature C.

To allow a particular wire to be matched to a particular brassiere cup, each of the wires is preformed during the molding process with a set of markings shown for the wire 40 at 56, 57, 58, 59, 60, 61 and 62. The markings 56 for the wires of the set lie along a line D1 which is a radius from the center C. Similarly, the markings 57 lie along a line D2, the markings 58 lie along a radius D3, the markings 59 lie along a radius D5 and the markings 60 lie along a radius D4 for the rectilinear portion 55 at one side of the set. Similarly on the opposite side the markings 61 and 65 lie along a radius D5 and a radius D2/D3/D4.

To select a wire for a particular size cup, therefore, the designer need merely select the wire 40 . . . 50 . . . whose arcuate portion 54 conforms to the curvature of the underside of the cup and then can cut the excess rectilinear portion off both the markings 59 and 61 for the D5 size or along other markings for other sizes. The excess can be cut off by a simple nail clipper and the end thus produced can be rounded.

This method clearly simplifies simple preparation and the design of a particular wire for a particular brassiere so that subsequent wires can be produced of appropriate length. Of course, the method allows a wide range of brassiere sizes to be made utilizing a single set of wires also by simply cutting off the excess and rounding the ends.

I claim:

1. A set of brassiere wires each having a circular segmental portion with a common center of curvature have all of the wires of said set and respective mutually parallel rectilinear portions, said wires being of substantially equal width uniform over the lengths thereof, being composed of plastic, being flat and coplanar and having inner and outer edges of lengths equal substantially to outer and inner edges of neighboring inwardly and outwardly lying wires of the set, said wires have radii of curvature of said arc segmental portions, total lengths and lengths of respective median lines between respective inner and outer edges which are graduated increasingly from a smallest wire of the set to a largest wire of the set, each of said rectilinear end portions being formed with a plurality of markings representing cutoff locations for matching the respective wire to a brassier cup of the respective size, the markings of the rectilinear portions of the wires of said set lying along radii from the center of said curvature.

2. The set of brassiere wires defined in claim 1 wherein at least one of said rectilinear portions is provided with at least two spaced apart grooves corresponding across the respective rectilinear portion in each face of the rectilinear portion.

3. A set of brassiere wires each having a circular segmental portion with a common center of curvature have all of the wires of said set and respective mutually parallel rectilinear portions, said wires being of substantially equal width uniform over the lengths thereof, being composed of plastic, being flat and coplanar and having inner and outer edges of lengths equal substantially to outer and inner edges of neighboring inwardly and outwardly lying wires of the set, said wires have radii of curvature of said arc segmental portions, total lengths and lengths of respective median lines between respective inner and outer edges which are graduated increasingly from a smallest wire of the set to a largest wire of the set, each of said rectilinear end portions being formed with a plurality of markings representing cutoff locations for matching the respective wire to a brassier cup of the respective size, said grooves including an outer groove closer to a tip of said rectilinear portion and an inner groove spaced from said outer groove away from said tip of the rectilinear portion, said wire having a lesser thickness at said outer groove than at said inner groove, whereby deflection of said rectilinear portion out of said plane imparts a continuous curvature to said rectilinear portion.

4. The brassiere wire defined in claim 3 wherein said outer groove defines an outer portion of said rectilinear portion with the tip thereof and an intermediate portion with said inner groove, said outer portion having a lesser thickness than said intermediate portion and said intermediate portion having a lesser thickness than said body.

5. The brassiere wire defined in claim 4 wherein said wire has a width measured in said plane of substantially 3.25 to 4.25 mm.

6. The brassiere wire defined in claim 5 wherein said width is 3.85 to 4.1 mm.

7. The brassiere wire defined in claim 6 wherein said body has a thickness of substantially 1.8 to 2.2 mm.

8. The brassiere wire defined in claim 7 wherein said wires have neutral middle lines between longitudinal edges thereof of lengths between substantially 184 mm and 387 mm at intervals of substantially 17 mm.

* * * * *